US011322086B2

(12) United States Patent
Kuo et al.

(10) Patent No.: US 11,322,086 B2
(45) Date of Patent: May 3, 2022

(54) LIGHT EMITTING APPARATUS AND DISPLAY DEVICE

(71) Applicant: Innolux Corporation, Miao-Li County (TW)

(72) Inventors: Kung-Chen Kuo, Miao-Li County (TW); Chin-Lung Ting, Miao-Li County (TW); Ker-Yih Kao, Miao-Li County (TW); Ming Chun Tseng, Miao-Li County (TW); Lien-Hsiang Chen, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 16/941,549

(22) Filed: Jul. 29, 2020

(65) Prior Publication Data

US 2021/0056900 A1 Feb. 25, 2021

Related U.S. Application Data

(60) Provisional application No. 62/888,583, filed on Aug. 19, 2019.

(30) Foreign Application Priority Data

Jun. 12, 2020 (CN) ..... 202010537580.3

(51) Int. Cl.
*G09G 3/3233* (2016.01)

(52) U.S. Cl.
CPC ... *G09G 3/3233* (2013.01); *G09G 2320/0233* (2013.01)

(58) Field of Classification Search
CPC ..... G09G 3/3233; G09G 2320/0233
See application file for complete search history.

(56) References Cited

U.S. PATENT DOCUMENTS 10,224,434 B2 * 3/2019 Shin ..... H01L 27/1222
10,665,154 B1 * 5/2020 Chen ..... G09G 3/3233
(Continued)

FOREIGN PATENT DOCUMENTS

CN 106097959 11/2016
CN 108986744 12/2018
KR 20030044567 6/2003

OTHER PUBLICATIONS

Office Action of China Counterpart Application, dated Jul. 2, 2021, pp. 1-10.

(Continued)

*Primary Examiner* — Stacy Khoo
(74) *Attorney, Agent, or Firm* — JCIPRNET

(57) ABSTRACT

A light emitting apparatus and a display device are provided. The light emitting apparatus includes a light emitting unit and a pixel circuit. The pixel circuit is electrically connected to the light emitting unit. The pixel circuit includes a first driving transistor and a second driving transistor. The first driving transistor and the second driving transistor are configured to provide a first driving current and a second driving current to the light emitting unit at the same time, respectively. The first driving transistor includes a first gate terminal. The second driving transistor includes a second gate terminal. The first gate terminal and the second gate terminal are electrically connected to different nodes. The display device includes the light emitting apparatus.

16 Claims, 5 Drawing Sheets

(56) References Cited

U.S. PATENT DOCUMENTS

| | | | | |
|---|---|---|---|---|
| 2016/0253958 | A1* | 9/2016 | Ma | G09G 3/3225<br>345/211 |
| 2021/0012709 | A1* | 1/2021 | Qian | G09G 3/3233 |

OTHER PUBLICATIONS

"Office Action of China Counterpart Application", dated Feb. 15, 2022, p. 1-p. 9.

* cited by examiner

200(200D)

LIGHT EMITTING APPARATUS AND DISPLAY DEVICE

CROSS-REFERENCE TO RELATED APPLICATION

This application claims the priority benefits of U.S. provisional application Ser. No. 62/888,583, filed on Aug. 19, 2019, and China application serial no. 202010537580.3, filed on Jun. 12, 2020. The entirety of each of the above-mentioned patent applications is hereby incorporated by reference herein and made a part of this specification.

BACKGROUND OF THE INVENTION

1. Field of the Invention

The invention relates to a light emitting apparatus and a display device, and more particularly, to a light emitting apparatus having a pixel circuit, and a display device having a light emitting apparatus.

2. Description of Related Art

A pixel circuit in a light emitting apparatus generally includes a driving transistor and a compensating circuit. The driving transistor is a current amplifier configured to convert a data voltage into a driving current that drives a pixel to emit light. However, due to variations in a manufacturing process, the driving transistors of each pixel circuit may have different critical voltage values, so that generated driving currents are inconsistent, resulting in uneven brightness of the light emitting apparatus.

SUMMARY OF THE INVENTION

According to an embodiment, a light emitting apparatus is provided. The light emitting apparatus includes a light emitting unit and a pixel circuit. The pixel circuit is electrically connected to the light emitting unit. The pixel circuit includes a first driving transistor and a second driving transistor. The first driving transistor and the second driving transistor are configured to provide a first driving current and a second driving current to the light emitting unit at the same time, respectively. The first driving transistor includes a first gate terminal. The second driving transistor includes a second gate terminal. The first gate terminal and the second gate terminal are electrically connected to different nodes.

According to an embodiment, a display device is provided. The display device includes a light emitting apparatus.

To make the features and advantages of the invention clear and easy to understand, the following gives a detailed description of embodiments with reference to accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

It should be understood that other embodiments can be utilized and structural changes can be made without departing from the scope of the present invention. Similarly, it should be understood that the word and term used herein are used for description purposes rather than limiting. The use of "comprising", "including" or "having" and variations thereof herein is intended to cover the items listed thereafter and equivalents thereof as well as additional items. Unless otherwise limited, the terms "connected", "coupled" and their variations herein are used broadly and cover direct and indirect connections and couplings.

Reference will now be made in detail to the present preferred embodiments of the invention, examples of which are illustrated in the accompanying drawings. Wherever possible, the same reference numbers are used for referring to the same or like parts.

Figure 1:
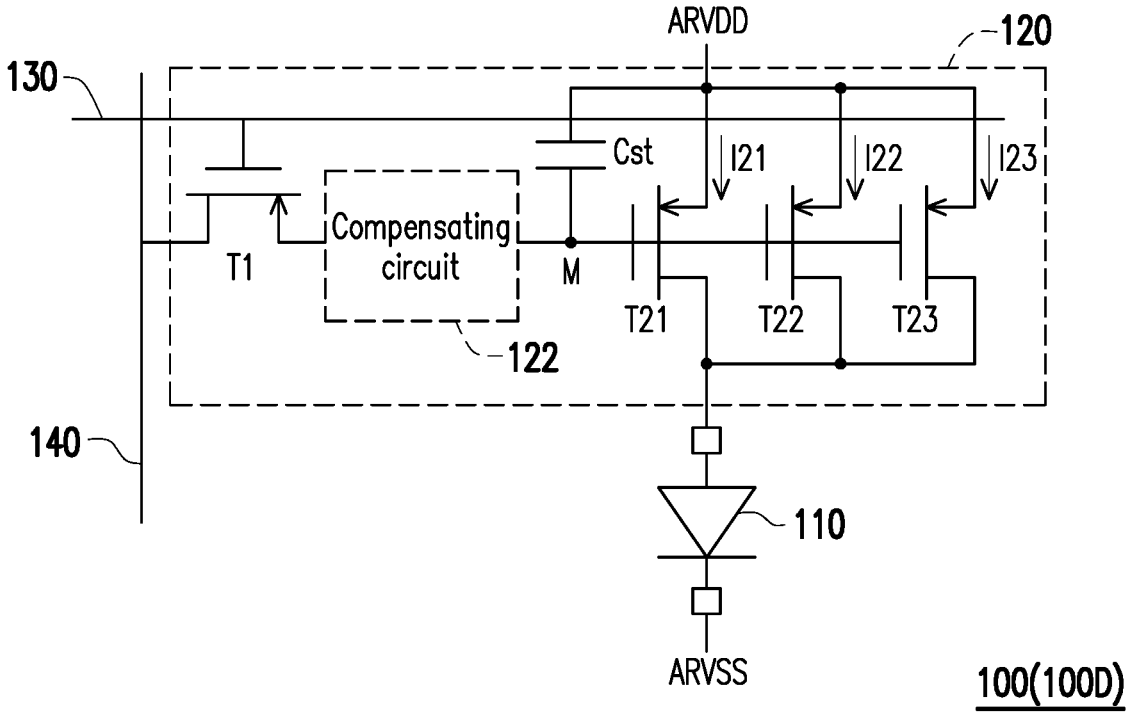
FIG. 1 illustrates a schematic diagram of a light emitting apparatus according to an embodiment of the invention.

FIG. 1 illustrates a schematic diagram of a light emitting apparatus according to an embodiment of the invention. Referring to FIG. 1, a light emitting apparatus 100 of the present embodiment includes a light emitting unit 110 and a pixel circuit 120. The pixel circuit 120 is electrically connected to the light emitting unit 110. The light emitting apparatus 100 operates between operating voltages ARVDD and ARVSS. According to some embodiments, the light emitting apparatus 100 itself may be used as a display device 100D. The display device may be a self-luminous display device, such as an organic light emitting diode (OLED) display device, a mini light emitting diode (LED) display device, a micro LED display device, or a quantum dot (QD) LED (for example, QLED or QDLED) display device.

Figure 5:
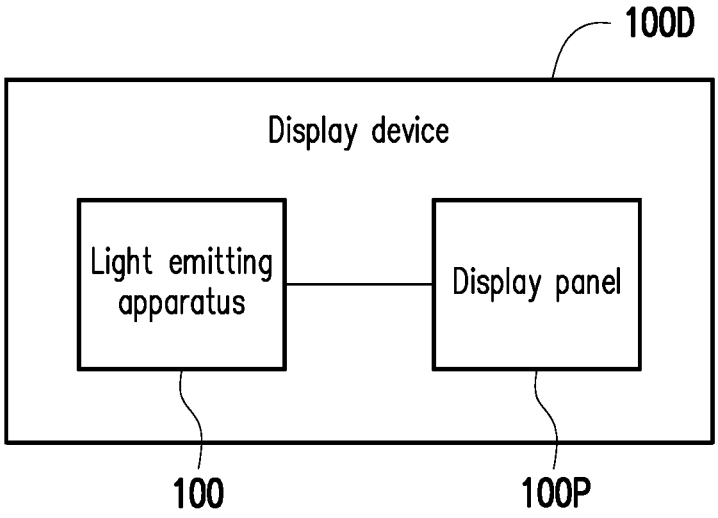
FIG. 5 illustrates a schematic diagram of a display device according to an embodiment of the invention.

Or, according to some embodiments, as shown in FIG. 5, the display device 100D may include the light emitting apparatus 100 and a display panel 100P. The light emitting apparatus 100 may serve as a light source of the display panel 100P, and may provide a light source to the display panel 100P. For example, the display panel 100P may be a liquid crystal display panel, the light emitting apparatus 100 may provide a backlight to the display panel 100P, and the display device 100D may be a liquid crystal display device. The type of the light emitting apparatus 100 is not limited in the invention.

The light emitting unit 110 includes an LED chip or an LED package. For example, the light emitting unit 110 may be one or more series or parallel LEDs, or one or more series or parallel LED strings. The LED may include, for example but not limited to, an OLED, a mini LED, a micro LED, or a QD LED (for example, QLED or QDLED), fluorescence, phosphor or other suitable materials which may be arranged and combined arbitrarily. The pixel circuit 120 includes a switch transistor T1, a compensating circuit 122, a storage capacitor Cst, and driving transistors T21, T22, and T23. The driving transistors T21, T22, T23 may have the same size, or may have different sizes. For example, the transistors have the same gate width, or the transistors have the same gate length. The switch transistor T1 is electrically connected to the compensating circuit 122. A gate terminal of the switch transistor T1 is coupled to a scanning line 130 of the light emitting apparatus 100. A first source/drain terminal of the switch transistor T1 is coupled to a data line 140 of the light emitting apparatus 100. A second source/drain terminal of the switch transistor T1 is coupled to the compensating circuit 122 of the light emitting apparatus 100. When the switch transistor T1 is turned on, a data voltage is input to the pixel circuit 120 through the data line 140. The driving transistors T21, T22, T23 are configured to provide driving currents I21, I22, I23 to the light emitting unit 110 at the same time, respectively. The sum of the driving currents I21, I22, and I23 is used as a larger driving current to drive the light emitting unit 110 to emit light. The gate terminals of the driving transistors T21, T22, T23 are electrically connected to a node M. The compensating circuit 122 is electrically connected to the gate terminals of the driving transistors T21, T22, T23.

In the present embodiment, the driving transistors T21, T22, T23 may have different critical voltage values due to variations in a manufacturing process. The compensating circuit 122 is configured to compensate the different critical voltage values to solve the problem of uneven display brightness.

Figure 2:
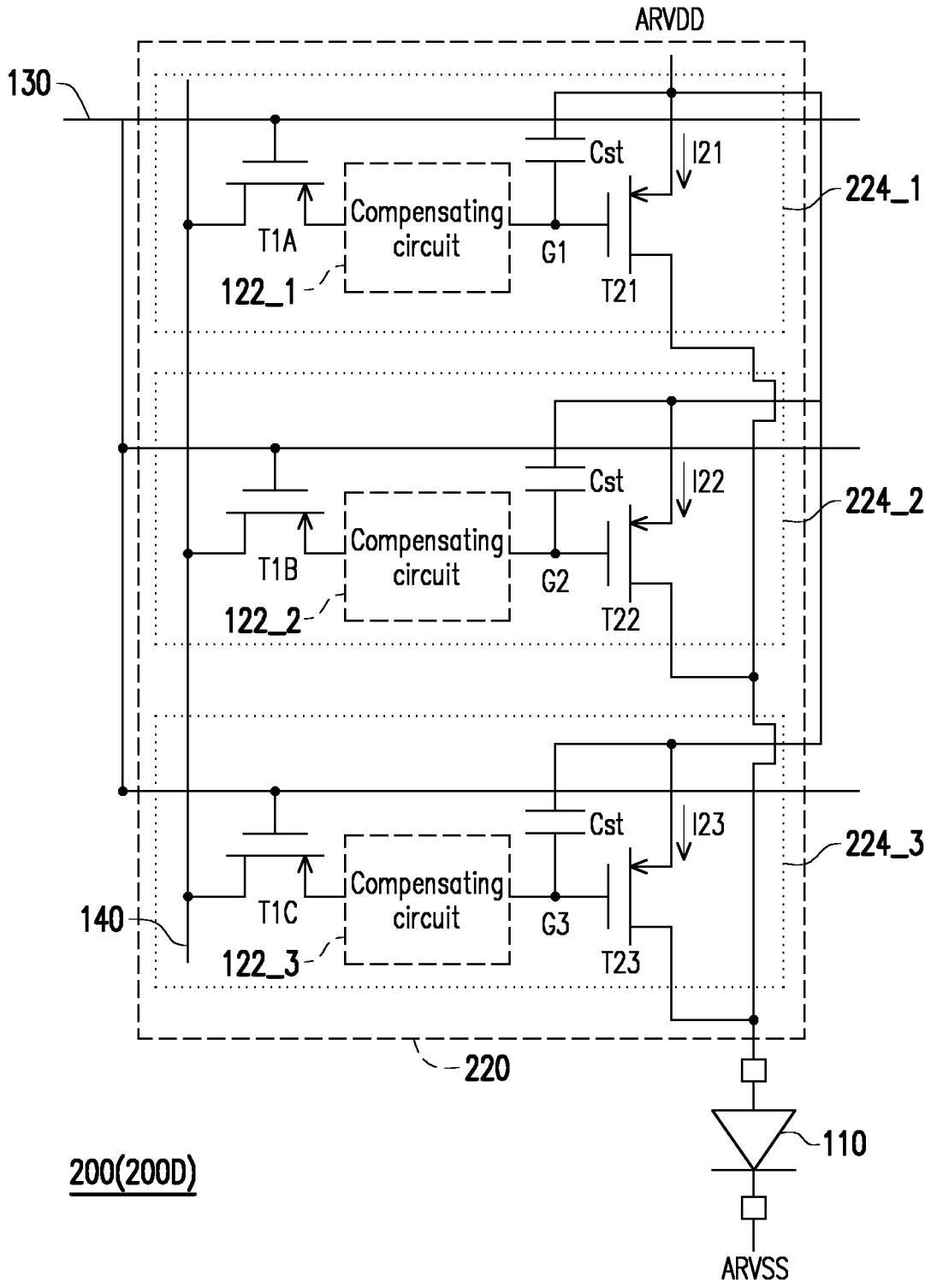
FIG. 2 illustrates a schematic diagram of a light emitting apparatus according to another embodiment of the invention.

FIG. 2 illustrates a schematic diagram of a light emitting apparatus according to another embodiment of the invention. Referring to FIG. 2, a display device 200D of the present embodiment includes a light emitting apparatus 200. The light emitting apparatus 200 includes a light emitting unit 110 and a pixel circuit 220. The pixel circuit 220 is electrically connected to the light emitting unit 110. The pixel circuit 220 includes a plurality of repeated blocks 224_1, a second repeated block 224_2, and a third repeated block 224_3. The number of repeated blocks is not used to limit the invention.

The first repeated block 224_1 includes a first switch transistor T1A, a first compensating circuit 122_1, a storage capacitor Cst, and a first driving transistor T21. The first driving transistor T21 includes a first gate terminal G1. The first compensating circuit 122_1 is electrically connected to the first gate terminal G1. The first switch transistor T1A is electrically connected to the first compensating circuit 122_1. The second repeated block 224_2 includes a second switch transistor T1B, a second compensating circuit 122_2, a storage capacitor Cst, and a second driving transistor T22. The second driving transistor T22 includes a first gate terminal G2. The second compensating circuit 122_2 is electrically connected to the second gate terminal G2. The second switch transistor T1B is electrically connected to the second compensating circuit 122_2. The third repeated block 224_3 includes a third switch transistor T1C, a third compensating circuit 122_3, a storage capacitor Cst, and a third driving transistor T23. The third driving transistor T23 includes a first gate terminal G2. The third compensating circuit 122_3 is electrically connected to a third gate terminal G3. The third switch transistor T1C is electrically connected to the third compensating circuit 122_3. The first driving transistor T21, the second driving transistor T22, and the third driving transistor T23 are configured to provide a first driving current I21, a second driving current I22, and a third driving current I23 to the light emitting unit 110 at the same time, respectively. The first gate terminal G1, the second gate terminal G2, and the third gate terminal G3 are electrically connected to different nodes. That is, in FIG. 2, the first gate terminal G1, the second gate terminal G2, and the third gate terminal G3 are different nodes in the pixel circuit 220. The sum of the first driving current I21, the second driving current I22, and the third driving current I23 is used as a larger driving current to drive the light emitting unit 110 to emit light.

In the present embodiment, the driving transistors T21, T22, T23 may have different critical voltage values due to variations in a manufacturing process. The pixel circuit 220 includes a plurality of compensating circuits 122_1, 122_2, and 122_3. The compensating circuit 122_1 may be configured to compensate a voltage value of the first gate terminal G1, the compensating circuit 122_2 may be configured to compensate a voltage value of the second gate terminal G2, and the compensating circuit 122_3 may be configured to compensate a voltage value of the third gate terminal G3. Specifically, the compensating circuits 122_1, 122_2, 122_3 receive a reset voltage and a reference voltage. The compensating circuits 122_1, 122_2, and 122_3 are configured to reset the voltage values of the first gate terminal G1, the second gate terminal G2, and the third gate terminal G3 according to the reset voltage, and reduce the dependence of critical voltage values and driving currents of their corresponding driving transistors T21, T22, and T23 according to an operating voltage ARVDD and the reference voltage. That is, the compensating circuits 122_1, 122_2, and 122_3 may be configured to compensate the critical voltage values of their corresponding driving transistors T21, T22, and T23 to solve the problem of uneven display brightness.

Figure 3:
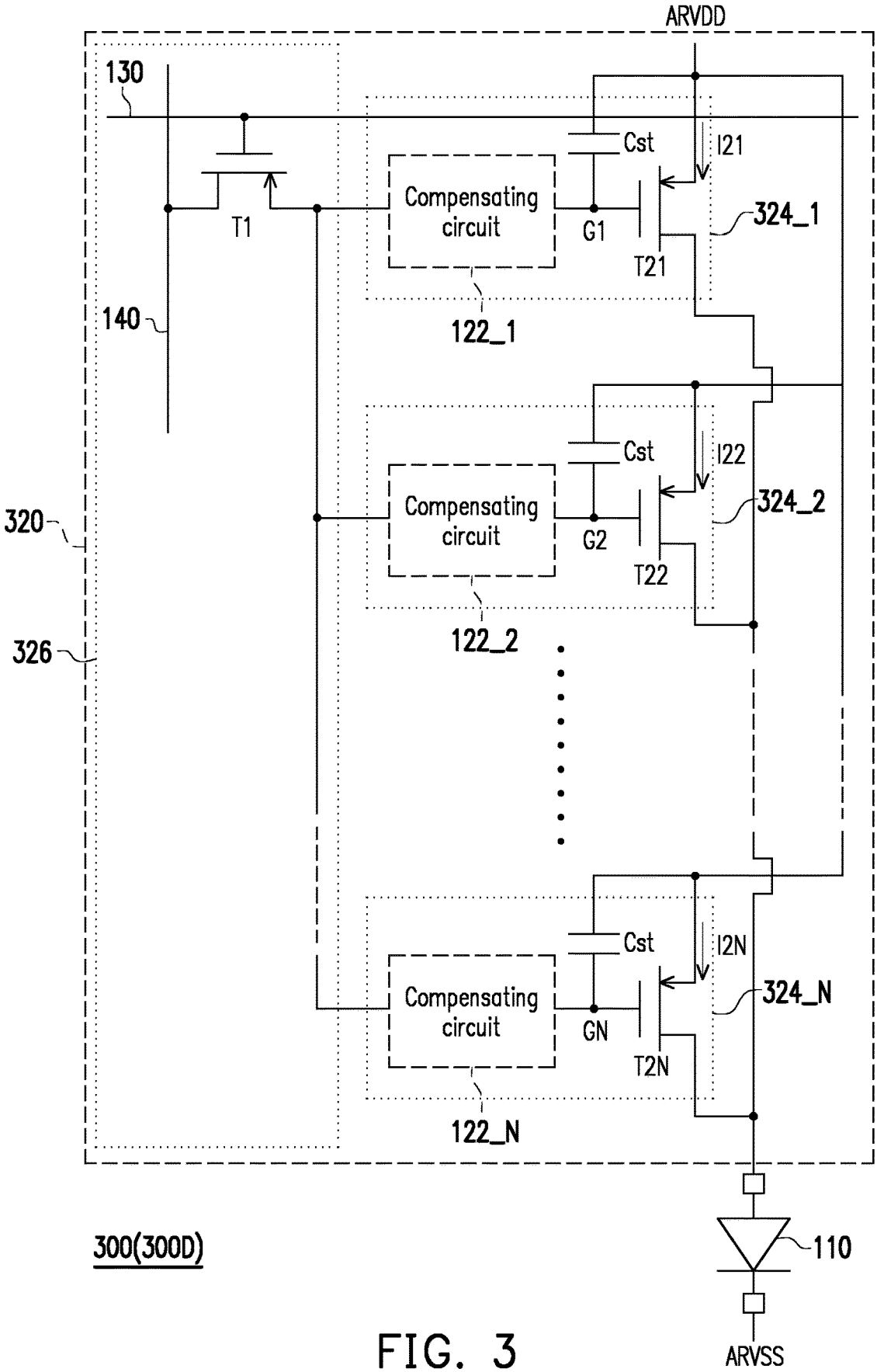
FIG. 3 illustrates a schematic diagram of a light emitting apparatus according to another embodiment of the invention.

FIG. 3 illustrates a schematic diagram of a light emitting apparatus according to another embodiment of the invention. Referring to FIG. 3, a display device 300D of the present embodiment includes a light emitting apparatus 300. The light emitting apparatus 300 includes a light emitting unit 110 and a pixel circuit 320. The pixel circuit 320 is electrically connected to the light emitting unit 110. The pixel circuit 320 includes a shared block 326, a first repeated block 324_1, a second repeated block 324_2 to an $N^{th}$ repeated block 324_N, where N is a positive integer. The number of shared blocks and repeated blocks is not used to limit the invention.

The first repeated block 324_1 includes a first compensating circuit 122_1, a storage capacitor Cst, and a first driving transistor T21. The first driving transistor T21 includes a first gate terminal G1. The first compensating circuit 122_1 is electrically connected to the first gate terminal G1. The second repeated block 324_2 includes a second compensating circuit 122_2, a storage capacitor Cst, and a second driving transistor T22. The second driving transistor T22 includes a first gate terminal G2. The second compensating circuit 122_2 is electrically connected to the second gate terminal G2. The $N^{th}$ repeated block 324_N includes an $N^{th}$ compensating circuit 122_N, a storage capacitor Cst, and an $N^{th}$ driving transistor T2N. The $N^{th}$ driving transistor T2N includes a first gate terminal GN. The $N^{th}$ compensating circuit 122_N is electrically connected to a third gate terminal GN. The first driving transistor T21, the second driving transistor T22 to the $N^{th}$ driving transistor T2N are configured to provide a first driving current I21, a second driving current I22 to an $N^{th}$ driving current I2N to the light emitting unit 110 at the same time, respectively. The first gate terminal G1, the second gate terminal G2 to the $N^{th}$ gate terminal GN are electrically connected to different nodes. That is, in FIG. 3, the first gate terminal G1, the second gate terminal G2 to the $N^{th}$ gate terminal GN are different nodes in the pixel circuit 320. The sum of the first driving current I21, the second driving current I22 to the $N^{th}$ driving current I2N is used as a larger driving current to drive the light emitting unit 110 to emit light.

The shared block 326 includes a terminal point of the switch transistor T1 electrically connected to the first compensating circuit 122_1, the second compensating circuit 122_2 to the $N^{th}$ compensating circuit 122_N.

In the present embodiment, the driving transistors T21, T22 to T2N may have different critical voltage values due to variations in a manufacturing process. The pixel circuit 320 includes a plurality of compensating circuits 122_1, 122_2 to 122_N. The compensating circuit 122_1 may be configured to compensate a voltage value of the first gate terminal G1, the compensating circuit 122_2 may be configured to compensate a voltage value of the second gate terminal G2, and the compensating circuit 122_3 may be configured to compensate a voltage value of the third gate terminal G3. That is, the compensating circuits 122_1, 122_2 to 122_N may be configured to compensate the critical voltage values of their corresponding driving transistors T21, T22 to T2N to solve the problem of uneven display brightness.

Figure 4:
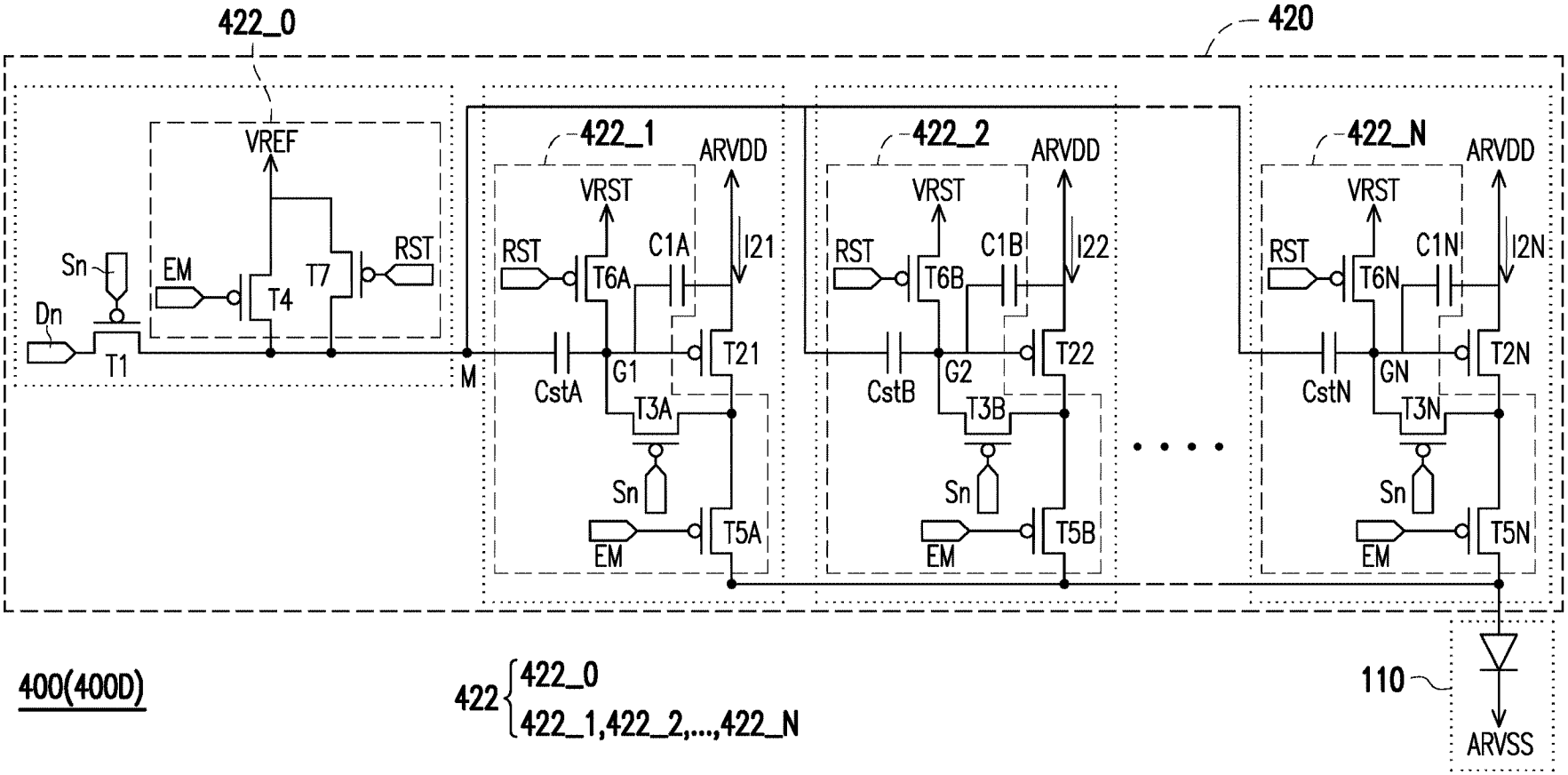
FIG. 4 illustrates a schematic diagram of a light emitting apparatus according to another embodiment of the invention.

FIG. 4 illustrates a schematic diagram of a light emitting apparatus according to another embodiment of the invention. Referring to FIG. 4, a display device 400D of the present embodiment includes a light emitting apparatus 400. The light emitting apparatus 400 includes a light emitting unit 110 and a pixel circuit 420. The pixel circuit 420 is electrically connected to the light emitting unit 110. The pixel circuit 420 includes a switch transistor T1, a first driving transistor T21, a second driving transistor T22 to an $N^{th}$ driving transistor T2N, and a compensating circuit 422, where N is a positive integer.

A gate terminal of the switch transistor T1 is coupled to a scanning line of the light emitting apparatus 400 through a contact Sn. A first source/drain terminal of the switch transistor T1 is coupled to a data line of the light emitting apparatus 400 through a contact Dn. A second source/drain terminal of the switch transistor T1 is coupled to the compensating circuit 422 of the light emitting apparatus 400. When the switch transistor T1 is turned on, a data voltage is input to the pixel circuit 420 through the contact Dn.

The first driving transistor T21 includes a first gate terminal G1, the second driving transistor T22 includes a second gate terminal G2, and the $N^{th}$ driving transistor T2N includes an $N^{th}$ gate terminal GN. The first gate terminal G1, the second gate terminal G2 to the $N^{th}$ gate terminal GN are electrically connected to different nodes, respectively. That is, in FIG. 4, the first gate terminal G1, the second gate terminal G2 to the $N^{th}$ gate terminal GN are different nodes in the pixel circuit 420. The first driving transistor T21, the second driving transistor T22 to the $N^{th}$ driving transistor T2N may have the same size, and may be configured to provide a first driving current I21, a second driving current I22 to an $N^{th}$ driving current I2N to the light emitting unit 110 at the same time, respectively. The sum of the first driving current I21, the second driving current I22 to the $N^{th}$ driving current I2N is used as a larger driving current to drive the light emitting unit 110 to emit light. Or, according to other embodiments, the first driving transistor T21, the second driving transistor T22 to the $N^{th}$ driving transistor T2N may have different sizes.

The pixel circuit 422 includes a shared unit 422_0, a first repeated unit 422_1, a second repeated unit 422_2 to an $N^{th}$ repeated unit 422_N. The number of shared units and repeated units is not used to limit the invention. The first repeated unit 422_1 is electrically connected to the shared unit 422_0 and the first gate terminal G1, the second repeated unit 422_2 is electrically connected to the shared unit 422_0 and the second gate terminal G2, and the $N^{th}$ repeated unit 422_N is electrically connected to the shared unit 422_0 and the $N^{th}$ gate terminal GN. The connection manner of other repeated units to the shared units and the gate terminals may be deduced by analogy.

The operation manner of the compensating circuit 422 compensating a critical voltage value of a driving transistor is described below. The operation manner of the compensating circuit 422 compensating a critical voltage value of a driving transistor may be mainly divided into three stages, namely a reset stage, a compensation stage, and a light emitting stage. The shared unit 422_0 and the first repeated unit 422_1 are taken as an example. In the reset stage, the node M and the gate terminal G1 are reset to a voltage VREF and a voltage VRST, respectively. In the compensation stage, a data voltage is written to the node M through the contact Dn. At this moment, a voltage value of the gate terminal G1 is ARVDD−|Vth1|, where ARVDD is a voltage value of an operating voltage ARVDD, and |Vth1| is an absolute value of a critical voltage value of the first driving transistor T21. Then, in the light emitting stage, the node M is set to the voltage VREF again. At this moment, the voltage value of the gate terminal G1 is ARVDD-|Vth1|+ΔV, where ΔV is a voltage difference between the operating voltage ARVDD and the data voltage at the node M. Therefore, the voltage difference Vsg between the source terminal and the gate terminal G1 of the first driving transistor T21 minus the absolute value |Vth1| of the critical voltage value of the first driving transistor T21 is equal to −ΔV, that is:

$$Vsg-|Vth1|=\text{ARVDD}-(\text{ARVDD}-|Vth1|+\Delta V)-|Vth1|=-\Delta V$$

Therefore, the first driving current I21 generated by the first driving transistor T21 is equal to kp(−ΔV)2, that is:

$$I21=kp(-\Delta V)^2$$

kp is a conduction parameter. The driving currents I22 to I2N generated by the remaining driving transistors T22 to T2N may be deduced by analogy. Therefore, according to the above compensation method, as a result, the dependence of the driving current on the critical voltage value of the driving transistor can be reduced, so that the problem of uneven display brightness can be solved. A circuit structure of the compensating circuit of the present embodiment and an operating mode of compensating the critical voltage value of the driving transistor are for illustration only. The compensating circuit of the present embodiment may be implemented by other suitable circuit structures without limiting the invention.

In the present embodiment, the driving transistors T21, T22 to T2N may have different critical voltage values due to variations in a manufacturing process. The pixel circuit 420 includes a compensating circuit 422. The compensating circuit 422 may be configured to compensate voltages of the first gate terminal G1, the second gate terminal G2 to the $N^{th}$ gate terminal GN. The pixel circuit 422 includes a plurality of repeated units 422_1, 422_2 to 422_N. The repeated units 422_1, 422_2 to 422_N cooperate with the shared unit 422_0 to compensate the critical voltage values of their corresponding driving transistors T21, T22 to T2N to solve the problem of uneven display brightness.

Based on the foregoing, according to some embodiments, the light emitting apparatus includes a light emitting unit and a pixel circuit. The pixel circuit includes a plurality of driving transistors for respectively providing driving currents to the same light emitting unit at the same time, respectively. A large and sufficient driving current may be provided. According to some embodiments, the pixel circuit includes one or more compensating circuits for compensating critical voltage values of individual driving transistors, thereby solving the problem of uneven display brightness of the light emitting apparatus.

A person skilled in the art can understand that variations and modifications can be made for a structure of the disclosed embodiments without departing from the spirit and scope of the present invention. Based on the foregoing content, the present invention covers the variations and modifications of the present invention as long as the variations and modifications fall within the scope of the appended claims and equivalents thereof.

What is claimed is:

1. A light emitting apparatus, comprising:

a light emitting unit; and a pixel circuit, electrically connected to the light emitting unit, the pixel circuit comprising:

a first driving transistor and a second driving transistor, configured to provide a first driving current and a second driving current to the light emitting unit at a same time, respectively, wherein the first driving transistor comprises a first gate terminal, the second driving transistor comprises a second gate terminal, and the first gate terminal and the second gate terminal are electrically connected to different nodes;

a first compensating circuit electrically connected to the first gate terminal; and a second compensating circuit electrically connected to the second gate terminal, wherein the first compensating circuit compensates a voltage value of the first gate terminal and the second compensating circuit compensates a voltage value of the second gate terminal at the same time.

2. The light emitting apparatus according to claim 1, wherein the light emitting unit comprises a light emitting diode (LED) chip or an LED package.

3. The light emitting apparatus according to claim 1, wherein the pixel circuit further comprises a first switch transistor and a second switch transistor, the first switch transistor is electrically connected to the first compensating circuit, and the second switch transistor is electrically connected to the second compensating circuit.

4. The light emitting apparatus according to claim 1, wherein the pixel circuit further comprises a switch transistor, and the switch transistor comprises a terminal point electrically connected to the first compensating circuit and the second compensating circuit.

5. The light emitting apparatus according to claim 1, wherein the first compensating circuit receives a reset voltage and is configured to reset a voltage value of the first gate terminal according to the reset voltage.

6. The light emitting apparatus according to claim 1, wherein the first driving transistor further comprises a first source/drain terminal and a second source/drain terminal, the second driving transistor further comprises a third source/drain terminal and a fourth source/drain terminal, the first source/drain terminal and the third source/drain terminal are electrically connected to a same operating voltage, and the second source/drain terminal and the fourth source/drain terminal are electrically connected to the same light emitting unit.

7. A display device, comprising the light emitting apparatus according to claim 1.

8. The display device according to claim 7, further comprising a display panel.

9. The light emitting apparatus according to claim 1, wherein the first compensating circuit compensates the first gate terminal and the second compensating circuit compensates the second gate terminal according to an operating voltage.

10. The light emitting apparatus according to claim 1, wherein the first driving transistor and the second driving transistor are electrically connected to a same operating voltage.

11. A light emitting apparatus, comprising:

a light emitting unit; and a pixel circuit, electrically connected to the light emitting unit, the pixel circuit comprising:

a first driving transistor and a second driving transistor, configured to provide a first driving current and a second driving current to the light emitting unit at a same time, respectively, wherein the first driving transistor comprises a first gate terminal, the second driving transistor comprises a second gate terminal, and the first gate terminal and the second gate terminal are electrically connected to different nodes; and a compensating circuit, comprising:

a shared unit;

a first repeated unit electrically connected to the shared unit and the first gate terminal; and a second repeated unit electrically connected to the shared unit and the second gate terminal, wherein the compensating circuit compensates a voltage value of the first gate terminal and a voltage value of the second gate terminal at the same time.

12. The light emitting apparatus according to claim 11, wherein the light emitting unit comprises a light emitting diode (LED) chip or an LED package.

13. The light emitting apparatus according to claim 11, wherein the pixel circuit further comprises a switch transistor, and the switch transistor comprises a terminal point electrically connected to the compensating circuit.

14. The light emitting apparatus according to claim 11, wherein the first driving transistor further comprises a first source/drain terminal and a second source/drain terminal, the second driving transistor further comprises a third source/drain terminal and a fourth source/drain terminal, the first source/drain terminal and the third source/drain terminal are electrically connected to a same operating voltage, and the second source/drain terminal and the fourth source/drain terminal are electrically connected to the same light emitting unit.

15. The light emitting apparatus according to claim 11, wherein the compensating circuit compensates the first gate terminal and the second gate terminal according to an operating voltage.

16. The light emitting apparatus according to claim 11, wherein the first driving transistor and the second driving transistor are electrically connected to a same operating voltage.

* * * * *